US007663553B2

(12) United States Patent
Chang et al.

(10) Patent No.: US 7,663,553 B2
(45) Date of Patent: Feb. 16, 2010

(54) DIELECTRIC RESONATOR ANTENNA (DRA) WITH A TRANSVERSE-RECTANGLE WELL

(75) Inventors: Tze-Hsuan Chang, Taipei (TW); Jean-Fu Kiang, Taipei (TW)

(73) Assignee: National Taiwan University, Taipei (TW)

( * ) Notice: Subject to any disclaimer, the term of this patent is extended or adjusted under 35 U.S.C. 154(b) by 73 days.

(21) Appl. No.: 12/038,190

(22) Filed: Feb. 27, 2008

(65) Prior Publication Data

US 2009/0184875 A1 Jul. 23, 2009

(51) Int. Cl.
*H01Q 1/38* (2006.01)

(52) U.S. Cl. ..... 343/700 MS; 343/846

(58) Field of Classification Search ..... 343/700 MS, 343/846, 848

See application file for complete search history.

(56) References Cited

U.S. PATENT DOCUMENTS 5,952,972 A * 9/1999 Ittipiboon et al. ..... 343/700 MS
6,995,713 B2 2/2006 Le Bolzer et al.
7,196,663 B2 3/2007 Bolzer et al.
2006/0214856 A1* 9/2006 Nakano et al. ..... 343/702
2008/0042903 A1* 2/2008 Cheng ..... 343/700 MS

FOREIGN PATENT DOCUMENTS

GB 2406218 * 3/2005
JP 2005142864 6/2005

* cited by examiner

*Primary Examiner*—HoangAnh T Le
(74) *Attorney, Agent, or Firm*—Rabin & Berdo, P.C.

(57) ABSTRACT

The present invention relates to a dielectric resonator antenna (DRA) with a transverse-rectangle well. The DRA comprising a substrate, a ground plane, a feed conductor, and a dielectric resonator. The resonator further includes a main body and a well penetrating the main body to enhance the electric field, to increase the radiation efficiency, to broaden the bandwidth, and to create new resonant mode. The DRA has the radiation pattern of broad beamwidth with vertical polarization. Accordingly, the invention can also be adjusted as WLAN 802.11a antenna.

9 Claims, 7 Drawing Sheets

DIELECTRIC RESONATOR ANTENNA (DRA) WITH A TRANSVERSE-RECTANGLE WELL

FIELD OF THE INVENTION

The present invention is related to dielectric resonator antenna, and more particularly, to a dielectric resonator antenna with transverse-rectangle well.

BACKGROUND OF THE INVENTION

The prior rectangle DRA is usually operated in a $TE_{111}$ mode, and the mode has a linearly-polarized radiation pattern with a wide beam and a bandwidth of approximately 6-10%, and having advantages of low loss and high radiation efficiency, and could be increased to more than 10% by using low-permittivity material with $\epsilon_r \leqq 10$.

The beamwidth of the broadside radiation for a typical sectorial antenna is about 120°, and the half power beamwidth (HPBW) of vertical polarization on H-plane is only about 80°, can not fulfill the requirement of the sectorial antenna.

As known, the quality factor is an important parameter to affect the antenna bandwidth. Besides, various radiation patterns can be obtained by choosing proper resonator shapes and exciting proper resonant modes, and the radiation efficiency is affected by the shape of the ground plane, for example, a W-shaped or a V-shaped ground plane is used to lower the cross-polarization level or to increase the gain of antenna. Bigger ground plane can be used to increase the gain and to decrease the backward radiation of antennas. A ground plane of pyramidal-horn shape has also been used to increase the gain of antenna.

U.S. Pat. No. 6,995,713 published on Feb. 7, 2006, entitled "Dielectric resonator wideband antennas " discloses a wideband antenna consisting of a dielectric resonator or DRA mounted on a substrate with an earth plane. The resonator is positioned at a distance x from at least one of the edges of the earth plane, x being chosen such that $0 \leqq x \leqq \lambda_{diel}/2$, with $\lambda_{diel}$ the wavelength in the dielectric of the resonator. This invention applies to wireless networks.

U.S. Pat. No. 7,196,663 published on Mar. 27, 2007 entitled "Dielectric resonator type antennas" relates to a dielectric resonator antenna comprising a block of dielectric material of which a first face intended to be mounted on an earth plane is covered with a metallic layer. According to the invention, at least one second face perpendicular to the first face is covered with a partial metallic layer having a width less than the width of this second face. The invention applies in particular to DRA antennas for domestic wireless networks.

JP Pub. No. 2005142864 published on Jun. 2nd, 2005 entitled "Dielectric resonator antenna" provides a dielectric resonant antenna whose band is widened. The resonant antenna has a dielectric resonator in a specified shape, a mount substrate where a feeder and ground electrodes are formed and the dielectric resonator is mounted, a loop as a conductor line which is formed on a flank of the dielectric resonator and annularly bent while having one end as a first connection point connected to the feeder and the other end as a second connection point connected to the ground electrodes, and a stub which is formed of a conductor extending from the loop of the dielectric resonator separately from the mount substrate. The first connection point is formed closer to the side of the stub than the second connection point and a patch is formed on the top surface of the dielectric resonator by patterning a metal conductor in a specified shape.

The above patents disclose DRAs having rectangular resonator. Also, there are different ways to increase the bandwidth, for example, stacking different sizes of resonators or shaping resonators to merge their frequency bands, coupling and combining the aperture of the slot antenna with a DRA, or sticking a metallic slice to the DRA to provide extra resonant mode and to change the distribution of electric field. However, the prior techniques will make the process more complex, and increase cost and size of the antenna. Moreover, the metallic slice will lower the radiation efficiency due to ohmic loss at high frequency.

SUMMARY OF THE INVENTION

Accordingly, the main objective of present invention is to provide a wideband dielectric resonator antenna (DRA) with wide-beam linearly polarized radiation pattern.

Furthermore, another objective of the present invention is to increase bandwidth by providing a DRA with a caved transverse-rectangle well. The DRA is small and has the characteristics of low metallic loss to achieve low enough Q factor and to provide linearly polarized radiation pattern.

An embodiment of the dielectric resonator antenna comprising a rectangle substrate, a feed conductor, a ground plane, and a resonator. The substrate has a first surface and a second surface. The ground plane has a hollow portion and formed on the first surface, besides, the feed conductor formed on the second surface. The dielectric resonator is located on the ground plane, further including a main body and a well. The main body has a first side and a second side, wherein the first side and the second side are vertical to the ground, and the well transversely penetrates through the first side and the second side.

The material of the dielectric resonator is low-temperature co-fired ceramic (LTCC) with a dielectric constant ranging from 10 to 100. The main body and the well are both shaped as rectangle, and the well transversely penetrates through the main body to enhance the electric field induced to the DRA, to increase the radiation efficiency, and to decrease the Q factor for broadening the bandwidth of the antenna. As is clearly illustrated in FIGS. 1, 2, 3A and 3B, the well 402 is formed in the main body 401. A portion of the main body that is in contact with the around plane 20 becomes a lower wall that defines the well 402. A distance from the lower side of the well 402 to the base of the main body 401, i.e. the thickness of the lower wall defining the well 402, is S (S>0). Thus, the $TE^y_{112}$ mode of the DRA is changed by the caved well to form a similar resonant mode to the $TE^y_{111}$ mode. The DRA has the radiation pattern of a broad beam width with a vertical polarization. The size and the relative position of the main body and the well can be adjusted to merge different frequency bands to provide a wideband DRA.

Accordingly, the longer side of the feed conductor is orthogonal to the longer side of the hollow portion, and the feed conductor extends and passes through the central part of the hollow portion. The main body is attached to the ground plane over a contact area, and the feed conductor extends and passes through the central part of the hollow portion. When the return loss is 10 dB, the radiation band ranges from 4.76 to 5.86 GHz.

The other objective of the present invention is to provide a design method of the DRA. The size of the main body is adjusted to change the resonant frequency of the DRA. Then the size and the relative position of the well are adjusted to increase the radiation bandwidth of the DRA. Finally, the size and the relative position of the hollow portion and the feed conductor are adjusted to match the impedance.

BRIEF DESCRIPTION OF THE DRAWINGS

The foregoing aspects, as well as many of the attendant advantages and features of this invention will become more apparent by reference to the following detailed description, when taken in conjunction with the accompanying drawings.

DESCRIPTION OF THE PREFERRED EMBODIMENT

Figure 1:
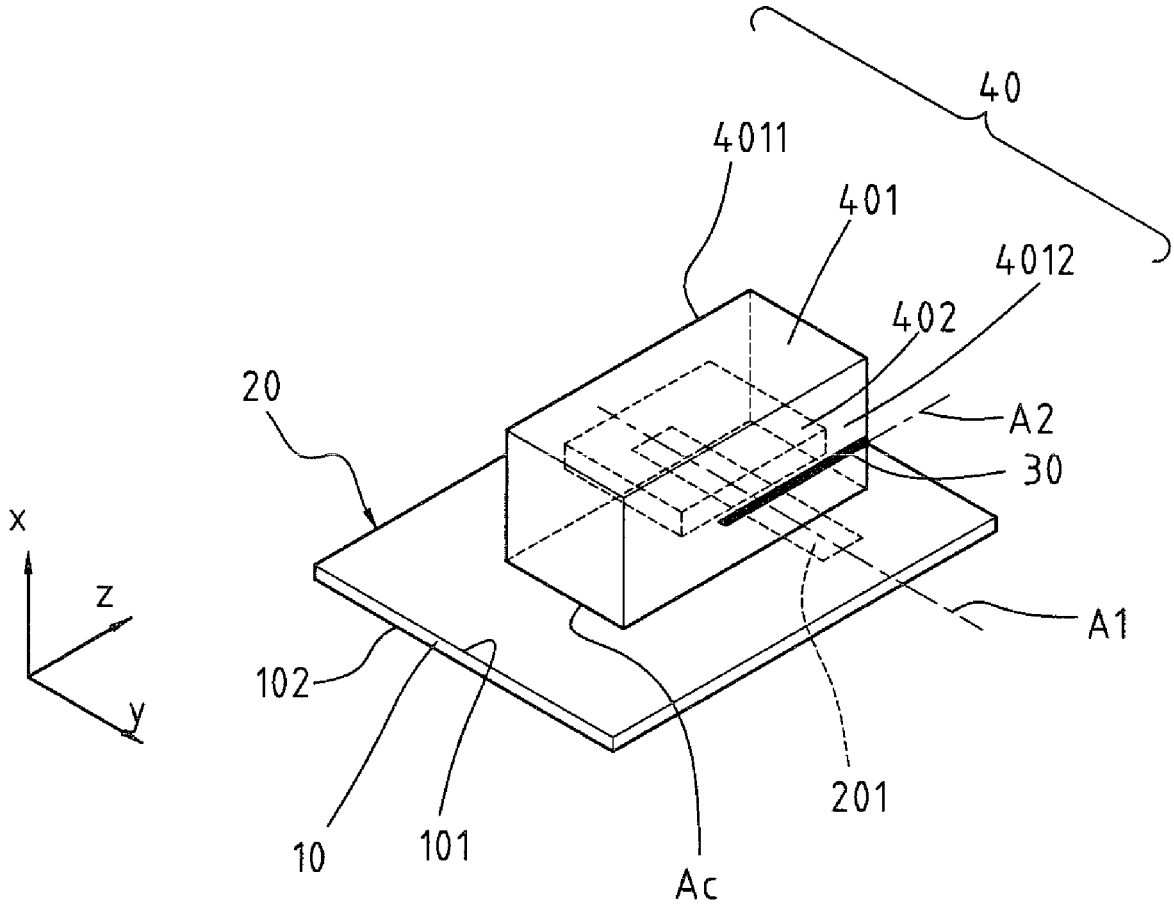
FIG. 1 is a perspective view in accordance with the present invention.

Referring to FIG. 1, illustrating the perspective view in accordance with the present invention. The present invention of the dielectric resonator antenna with transverse-rectangle well comprising:

a dielectric substrate 10 of plate shape including a first surface 101 and a second surface 102, which is a printed circuit board made of a material having a dielectric constant of 2-13, for example, an FR4 substrate with the dielectric constant of 4.4;

a ground plane 20 of metallic material forming on the first surface 101, and further including a rectangular hollow portion 201, of which the longer side extends along a first axis A1;

a feed conductor 30 formed on the second surface 102, according to an embodiment of the present invention, the feed conductor 30 extends along a second axis A2 and passes through the central part of the hollow portion 201, wherein the first axis A1 is perpendicular to the second axis A2.

a resonator 40 of dielectric material mounted on the ground plane 20, further including a main body 401 and a caved well 402 both shaped as rectangle. The main body 401 having a first side 4011 and a second side 4012, which are vertical to the ground plane 20. The well 402 penetrates through the first side 4011 and the second side 4012. The material of resonator 40 provides the characteristics with high dielectric constant between 10 to 100 and low loss tangent of about 0.002 to provide high radiation efficiency. The main body 401 partially overlaps with the hollow portion 201. Besides, the well 402 could be chosen to overlap with the hollow portion 201 or lapse from the hollow portion 201. The direction of longer side of the main body 401 is the same as the second axis $A_2$. The main body 401 is mounted on the ground plane 20 over a contact area Ac, and the second axis passes through the central part of the contact area.

Figure 2:
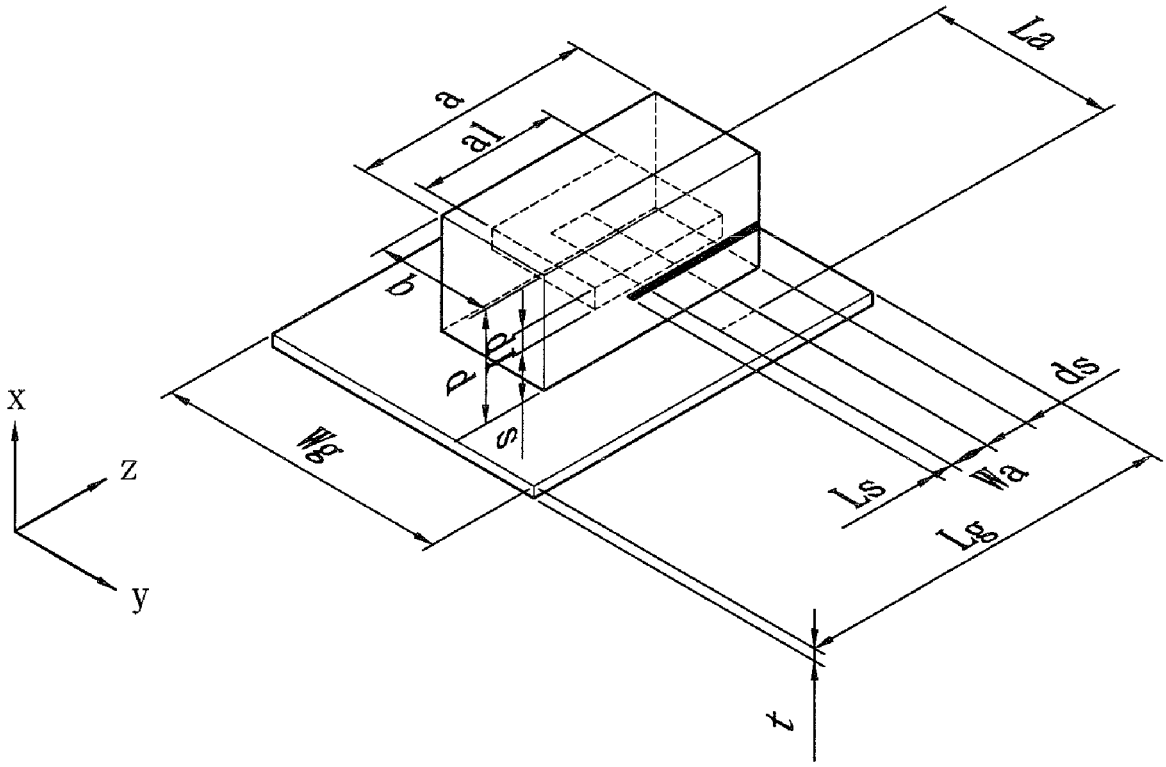
FIG. 2 is a diagram illustrating the size of different parts of the present invention.

FIG. 2 is a plan diagram illustrating the size of different parts of the present invention. Furthermore, sizes of different parts of the DRA 1 of the preferred embodiment are given as follows, in which the main body 401 has a length a, a width b, and a height d, the well 402 has a length a1, a width b, a height $d_1$, and the distance from the lower side of the well 402 to the base of the main body 401 is S, wherein a=21.2 mm, b=7.7 mm, d=7.25 mm, $d_1$=2.9 mm, and S=3.3 mm. The hollow portion 201 has a length $W_a$ and a width $L_a$, wherein Wa=2 mm, and $L_a$=13 mm. Both of the substrate 10 and the ground plane 20 have a length $W_g$ and a width $L_g$, and the thickness of the substrate 10 is t, in which $W_g$=$L_g$=60 mm, t=0.6 mm, and the dielectric constant of the substrate is $\epsilon_r$=4.4. The dielectric constant $\epsilon_r$ of the dielectric resonator 40 is 20. Moreover, the relative distance between the edge of the main body 401 and the hollow portion 201 is $d_s$, wherein $d_s$=7.2 mm. The length of the feed conductor 30 extending over the hollow portion 201 is Ls, wherein Ls=8 mm.

Figure 3A:
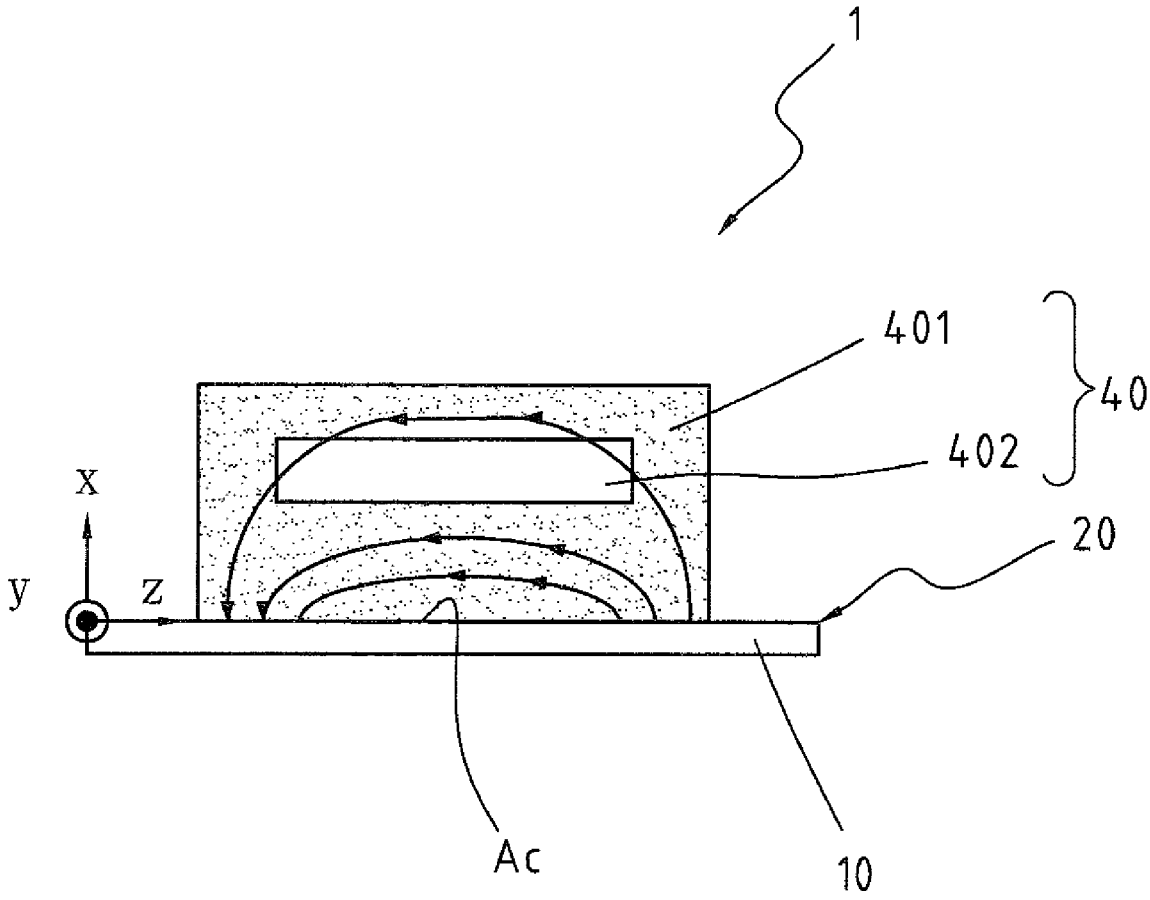
FIG. 3A and the FIG. 3B show the field distributions inside the DRA of the present invention.
Figure 3B:
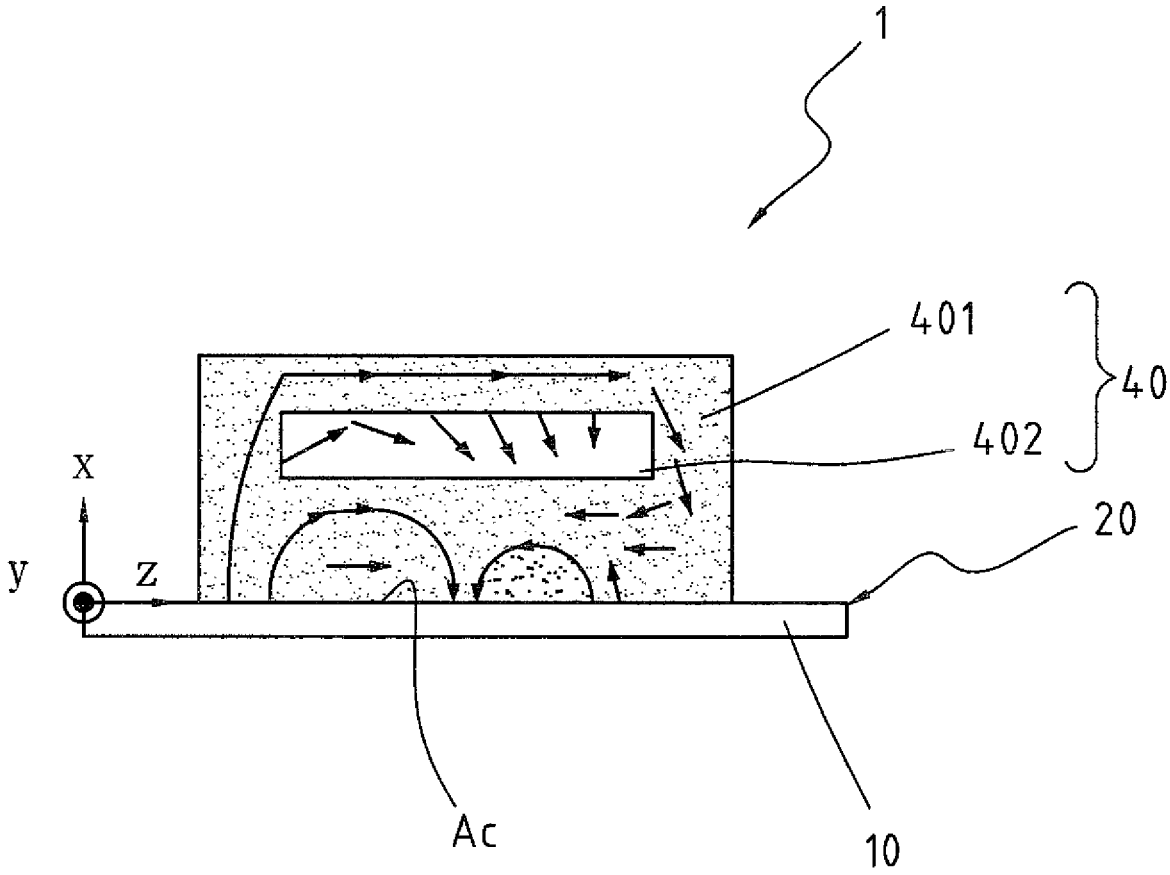

FIG. 3A and FIG. 3B show the field distributions of the present invention at frequency 4.89 GHz and 5.725 GHz, respectively. While radiating the wireless signal, the electronic signal is fed into the feed conductor 30 and the hollow portion 201 then coupled to the dielectric resonator 40. The electric field is enhanced because of the electric field line passing through the well 402 of the dielectric resonator 40. Therefore, the electric field of $TE^y_{112}$ mode is redistributed to increase the bandwidth of the radiation signal.

Figure 4:
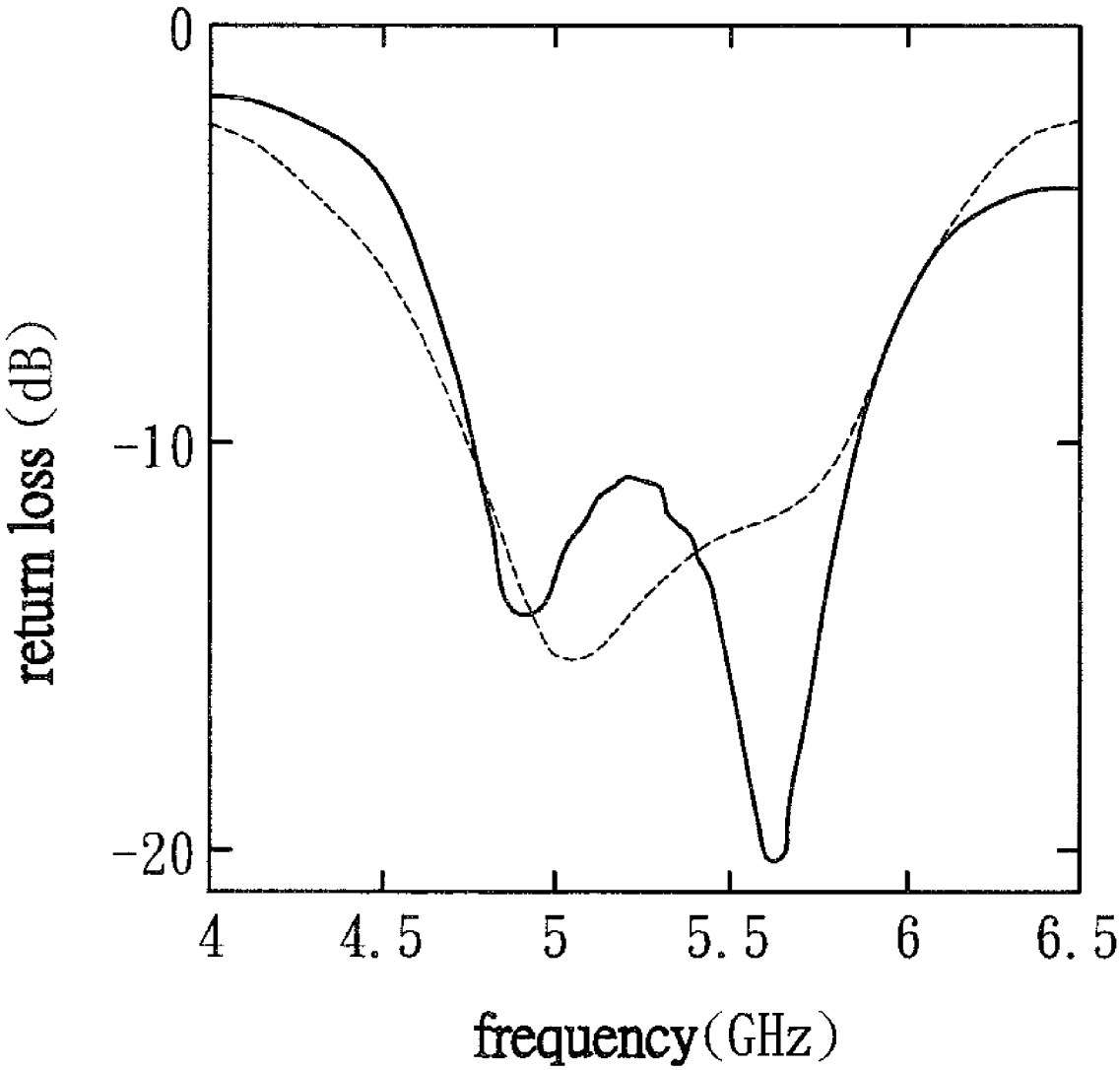
FIG. 4 shows the diagram of the return loss of the present invention.

FIG. 4 shows the return loss of the present invention illustrating the radiation efficiency of the DRA 1. Solid line is the measured return loss, and the dash line is the simulated return loss. The radiation frequency band having a low return loss of lower than −10 dB is between 4.76 GHz and 5.86 GHz.

Figure 5A:
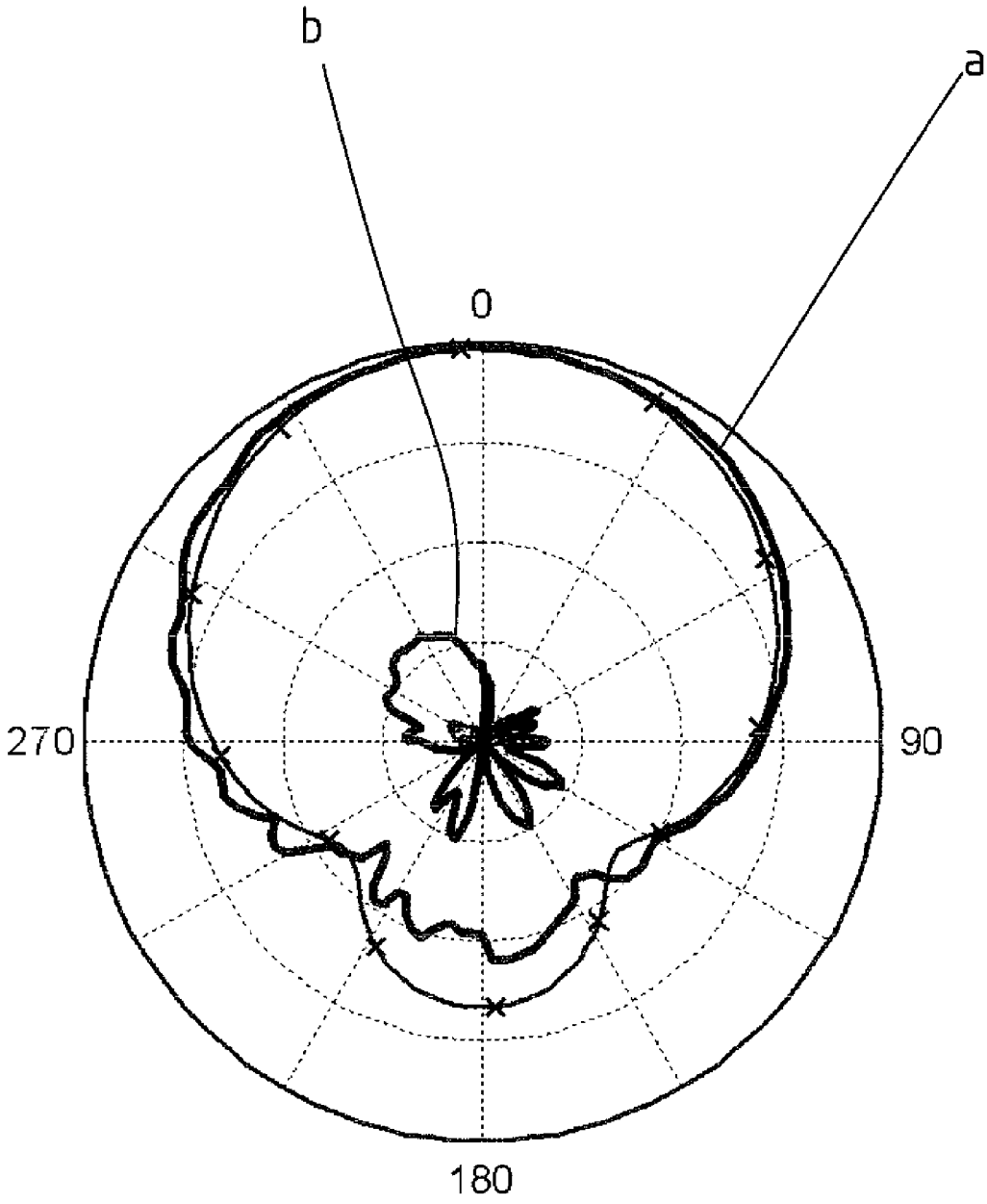
FIG. 5A and FIG. 5B show radiation patterns of the embodiment of the present invention.
Figure 5B:
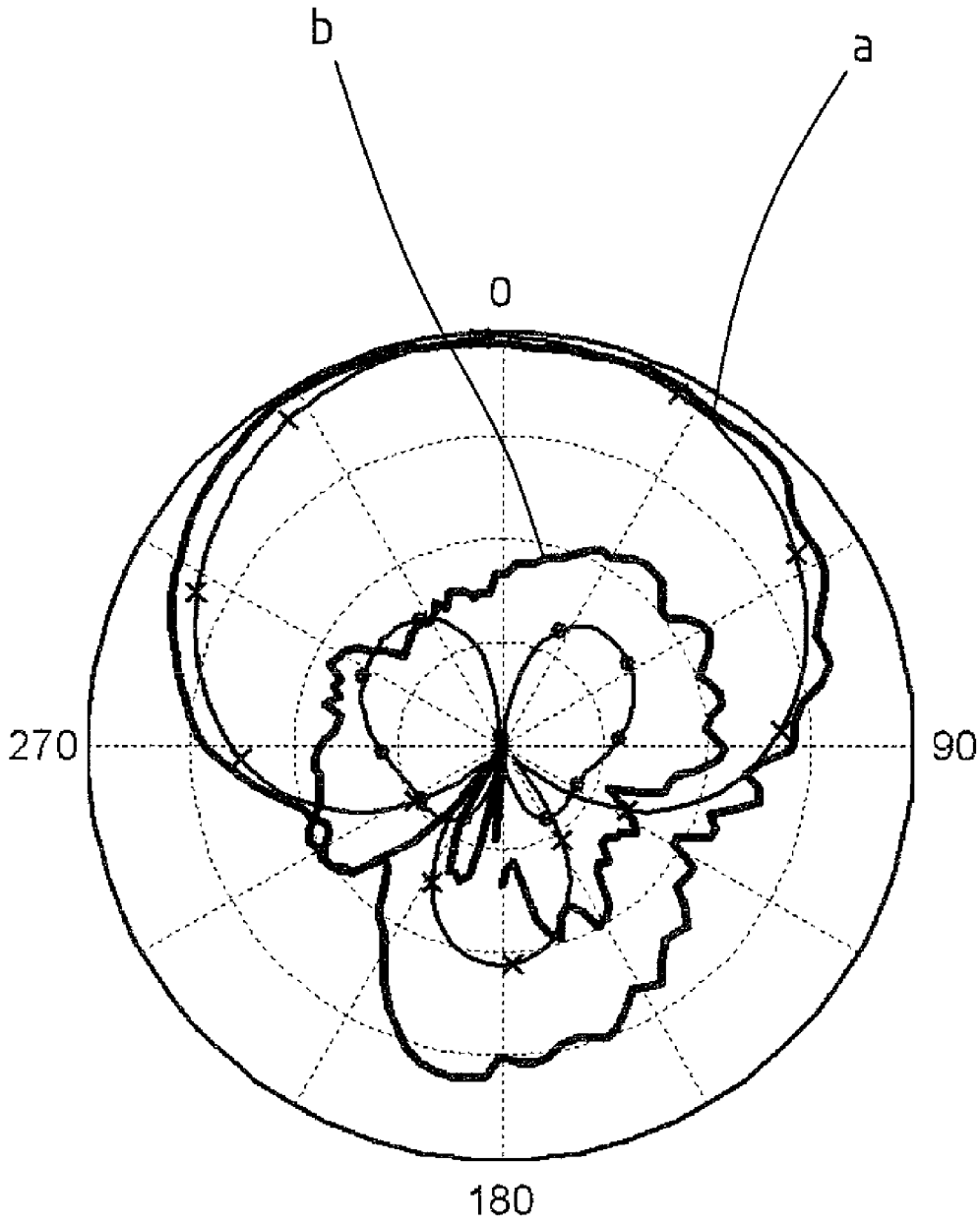

FIG. 5A and FIG. 5B show the radiation patterns of the embodiment of the present invention on the xy-plane at frequencies of 4.89 GHz, and 5.73 GHz respectively, in which the line a is the measurement of the vertical polarization, and the line b is the measurement of the horizontal polarization. The gains of the vertical polarization are 5.6 dBi and 3.6 dBi at 4.89 GHz and 5.73 GHz, respectively.

In addition, it should be noted that some performance of the DRA 1 provided by the present invention can be controlled by adjusting related elements. For example, (1) the size of the main body 401 of the dielectric resonator 40 is fine-adjusted to adjust the resonant frequency of the DRA 1, and/or (2) the size and the relative position of the well 402 is adjusted to adjust the frequency of the $TE^y_{112}$ mode and to increase the bandwidth, moreover, to form the wideband by merging the frequency bands, and/or (3) the size and the relative position of the hollow portion 201 and the feed conductor 30 is fine-adjusted to match the impedance of the DRA 1.

Therefore, the present invention of the DRA radiates the electromagnetic wave efficiently by caving a well to lower the antenna quality factor (Q factor), and the bandwidth of the DRA cover 4.76-5.86 GHz frequency band corresponding to the requirement of the wireless local area network (WLAN) 802.11a equipments. Furthermore, the electric field of $TE^y_{112}$ is changed by the well to form a new resonate mode, and is merged with the frequency band of the higher resonant mode. Thus, impedance bandwidth is increased to 20%. The DRA of the present invention has vertically polarized radiation pattern and is easy to integrate with a circuit board.

While the invention has been particularly shown and described with reference to the preferred embodiments thereof, these are, of course, merely examples to help clarify the invention and are not intended to limit the invention. It will be understood by those skilled in the art that various changes, modifications, and alterations in form and details may be made therein without departing from the spirit and scope of the invention, as set forth in the following claims.

What is claimed is:

1. A dielectric resonator antenna, comprising:

a substrate, having a first surface and a second surface;

a ground plane, having a hollow portion and being formed on the first surface;

a feed conductor, formed on the second surface; and a resonator of a dielectric material mounted on the ground plane, and further including:

a main body having a first side and a second side both vertical to the ground plane, and, a transverse-rectangular well formed in the main body, the well transversely penetrating through the first side and the second side, so that a portion of the main body becomes a lower horizontal wall defining the well, formed in between the well and the ground plane.

2. The dielectric resonator antenna as claimed in claim 1, wherein the main body of the dielectric resonator is of a rectangle shape.

3. The dielectric resonator antenna as claimed in claim 1, wherein the well of the dielectric resonator is rectangle shape.

4. The dielectric resonator antenna as claimed in claim 1, wherein the dielectric constant of the dielectric resonator is between 10 to 100.

5. The dielectric resonator antenna as claimed in claim 1, wherein a longer side of the feed conductor is orthogonal to a longer side of the hollow portion.

6. The dielectric resonator antenna as claimed in claim 1, wherein the feed conductor extends and passes through a central part of the hollow portion.

7. The dielectric resonator antenna as claimed in claim 1, wherein the main body is mounted on the ground plane over a contact area, and the feed conductor extends and passes through a central part of the hollow portion.

8. The dielectric resonator antenna as claimed in claim 1, wherein the dielectric resonator antenna is adapted to radiate a radiation frequency between 4.76 to 5.86 GHz with a return loss lower than −10 dB.

9. The dielectric resonator antenna of claim 1, wherein the well contains therein an empty space that is free of an object of another dielectric material.

* * * * *